US006554120B2

(12) United States Patent
Okachi

(10) Patent No.: US 6,554,120 B2
(45) Date of Patent: Apr. 29, 2003

(54) WORK SHEET PROCESSING SYSTEM

(75) Inventor: Kenji Okachi, Kounan (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/984,815

(22) Filed: Oct. 31, 2001

(65) Prior Publication Data

US 2002/0066990 A1 Jun. 6, 2002

(30) Foreign Application Priority Data

Dec. 1, 2000 (JP) ..... 2000-366676

(51) Int. Cl.[7] ..... B65G 37/00

(52) U.S. Cl. ..... 198/346.2; 198/341.01; 198/341.05

(58) Field of Search ..... 198/346.2, 341.01, 198/341.05, 341.08, 468.01, 468.4; 271/3.14

(56) References Cited

U.S. PATENT DOCUMENTS 4,144,960 A * 3/1979 Scourtes ..... 198/346.1
6,179,547 B1 * 1/2001 Hayakawa ..... 414/788.4

* cited by examiner

*Primary Examiner*—Donald P. Walsh
*Assistant Examiner*—Kaitlin Joerger
(74) *Attorney, Agent, or Firm*—Armstrong, Westerman & Hattori, LLP

(57) ABSTRACT

The object of the present invention is to provide a work sheet processing system wherein the material work sheet can be transported in and the product work sheet can be transporting out efficiently, and the cycle time of the processing can be shortened.

The work sheet processing system comprises a work sheet processing machine 3, and a loader 5 for transporting the material work sheet W onto the table 7 of the work sheet processing machine 3 and transporting out the product work sheet M from the table. The loader 5 includes a work sheet holding means 18 comprised of a material work sheet holding tool 19 and a product work sheet holding tool 20. The work sheet processing system further comprises a processing machine control means 31 and a loader control means 32. The processing machine control means 31 controls the work sheet processing machine 3 so that the work sheet processing machine 3 opens an area on the table for the material work sheet W to be transported in by the loader 5, and the product work sheet M to be on standby by being placed within the area the product work sheet holding tool 20 is capable of being transported out. The loader control means 32 controls the loader 5 so that the loader 5 holds onto the product work sheet M, and when the material work sheet M is placed on the table 7, transports out the product work sheet M.

3 Claims, 4 Drawing Sheets

WORK SHEET PROCESSING SYSTEM

FIELD OF THE INVENTION

The present invention relates to a work sheet processing system for transporting a material work sheet by a loader into a work sheet processing machine such as a punch press or a laser processing machine, and transporting out by the loader, a product work sheet processed by the work sheet processing machine.

BACKGROUND OF THE INVENTION

According to the conventional work sheet processing system of such kind, the product work sheet processed by the work sheet processing machine and located on a work table is transported out by the loader, and the next material work sheet is to be transported onto the work table by the loader after the surface of the work table is cleared.

However, under such structure, there is a problem in that the cycle time of the processing is to be long due to the work sheet making two round trips between the loader work sheet processing machine and the transporting in-and-out position for the material work sheet to be transported into the work sheet processing machine from the transporting in-and-out position and the processed product work sheet to be transported out to the transporting in-and-out position from the work sheet processing machine. By providing an exclusive unloader apart from the loader, the efficiency can be improved. However, in such case, the structure of the entire system is to be complicated, the set-up cost is to be expensive, and the occupying floor space is to increase.

The object of the present invention is to solve such problems and to provide a work sheet processing system capable of transporting in the material work sheet and transporting out the product work sheet efficiently, and shortening the cycle time of the processing.

SUMMARY OF THE INVENTION

The structure of the present invention will now be described in reference to FIG. 1 which corresponds to the embodiment. The work sheet processing system comprises a work sheet processing machine 3 for processing a work sheet W, and a loader 5 for transporting a material work sheet W onto a table 7 of the work sheet processing machine 3 and for transporting out the processed product work sheet M from the table 7 of the work sheet processing machine 3. The loader 5 comprises a work sheet holding means 18 which is comprised of a material work sheet holding tool 19 for holding the material work sheet W, and a product work sheet holding tool 20 for holding the product work sheet M. Furthermore, the work sheet processing system comprises a processing machine control means 31 and a loader control means 32. The processing machine control means 31 controls the work sheet processing machine 3 so that the work sheet processing machine 3 opens an area on the table 7 for the material work sheet W to be transported in by the loader 5, and the product work sheet M to be on standby by being placed within the area the product work sheet holding tool 20 of the loader 5 is capable of being transported out. The loader control means 32 controls the loader 5 so that the loader 5 holds onto the product work sheet M and then transports it out when the material work sheet W is placed on the table 7.

According to the structure, when the loader 5 transports the material work sheet W onto the table 7 of the work sheet processing machine 3, the product work sheet M on standby on the table 7 is held by the same loader 5 and can be transported out. Therefore, the material work sheet W can be transported into the work sheet processing machine 3 and the product work sheet M can be transported out from the work sheet processing machine 3 by an operation of one round trip of the loader 5. Further, the material work sheet holding tool 19 and the product work sheet holding tool 20 can be of the same structure to one another.

According to the present invention, a position changing control means 34 can be provided for the work sheet processing machine 3 to carry out the position changing operation so that the position of the product work sheet M is to be changed to the area where it can be transported out by the product work sheet holding tool 20 in the case the product work sheet M is not located within the area where it can be transported out by the product work sheet holding tool 20 of the loader 5.

If constructed likewise, the position of the product work sheet M is changed by the position changing control means 34 to the area capable of being transported out. Therefore, even in the case in which the processing shape or the processing form of the work sheet differ variously, the material work sheet W can be transported in and the product work sheet M can be transported out by one round trip of the loader 5.

Moreover, the work sheet processing machine 3 comprises a work sheet feeding device 9 for feeding the work sheet W to be processed. The position changing control means 34 can be made to control the work sheet feeding device 9.

If constructed likewise, the work sheet feeding device 9 for feeding the work sheet W can be used for changing the position of the product work sheet M. As a result, a special mechanism for changing the position of the product work sheet M becomes unnecessary.

Further, the processing machine control means 31 can be having a function to control the work sheet processing machine 3 as to transfer the product work sheet M on the table 7 by the work sheet feeding device 9 to the area capable of being transported out by the product work sheet holding unit 20 of the loader 5, and to make the work sheet feeding device 9 to be on standby at a position where the material work sheet W can be transported in by being separated from the product work sheet M. Accordingly, it can be prepared for the transporting in of the material work sheet W.

DETAILED DESCRIPTION OF THE PREFERRED EMBODIMENTS

An embodiment of the present invention will now be described in reference to the accompanying drawings, FIG.

Figure 5A:
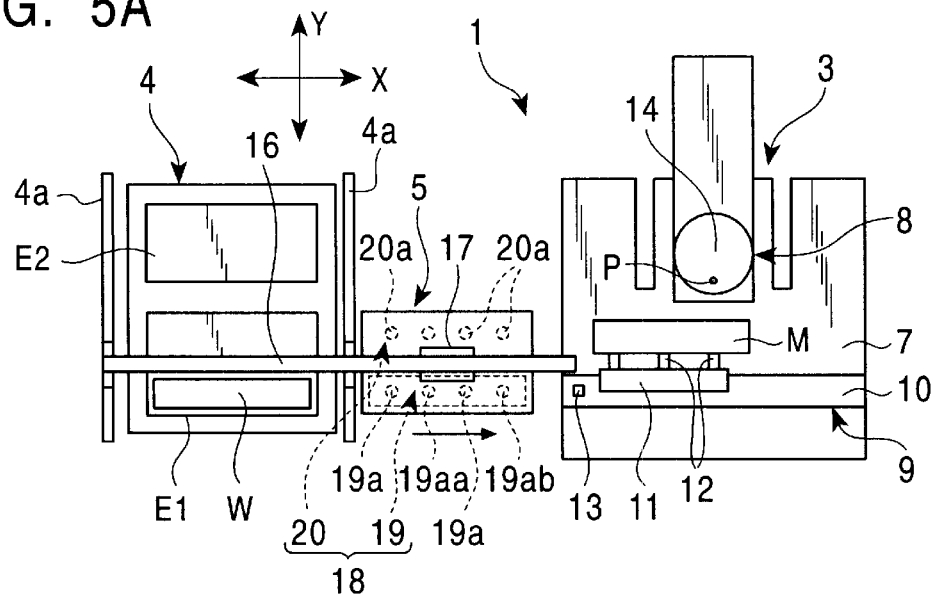
FIG. 5 is a view useful for explaining the material work sheet being transported in and the product work sheet being transported out by the system of the same.
Figure 5B:
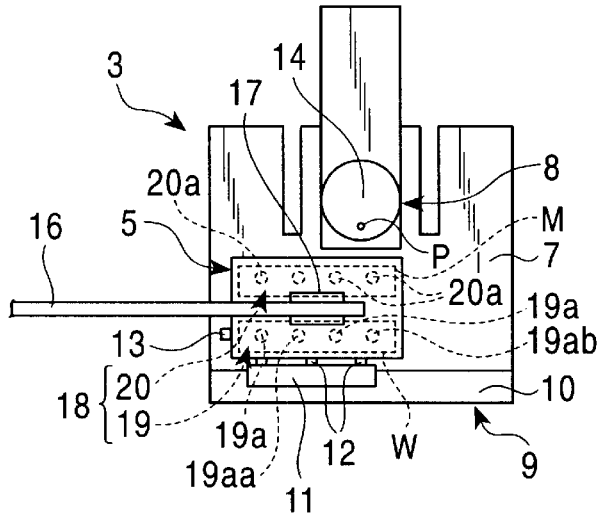
Figure 5C:
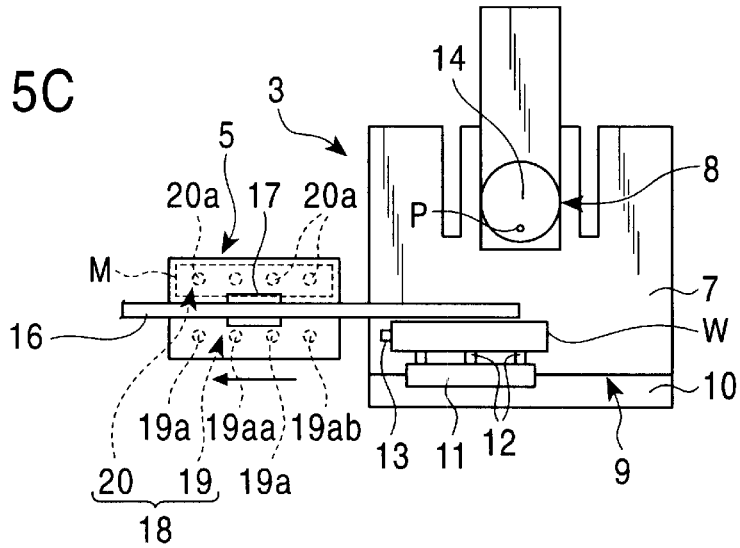

1 through FIG. 5. The work sheet processing system is construed by a processing-transporting machine unit 1 and a system control means 2. First, the processing-transporting machine unit 1 will be described along with FIG. 1 through FIG. 3, and then the system control means 2 will be described in reference to FIG. 1.

Figure 1:
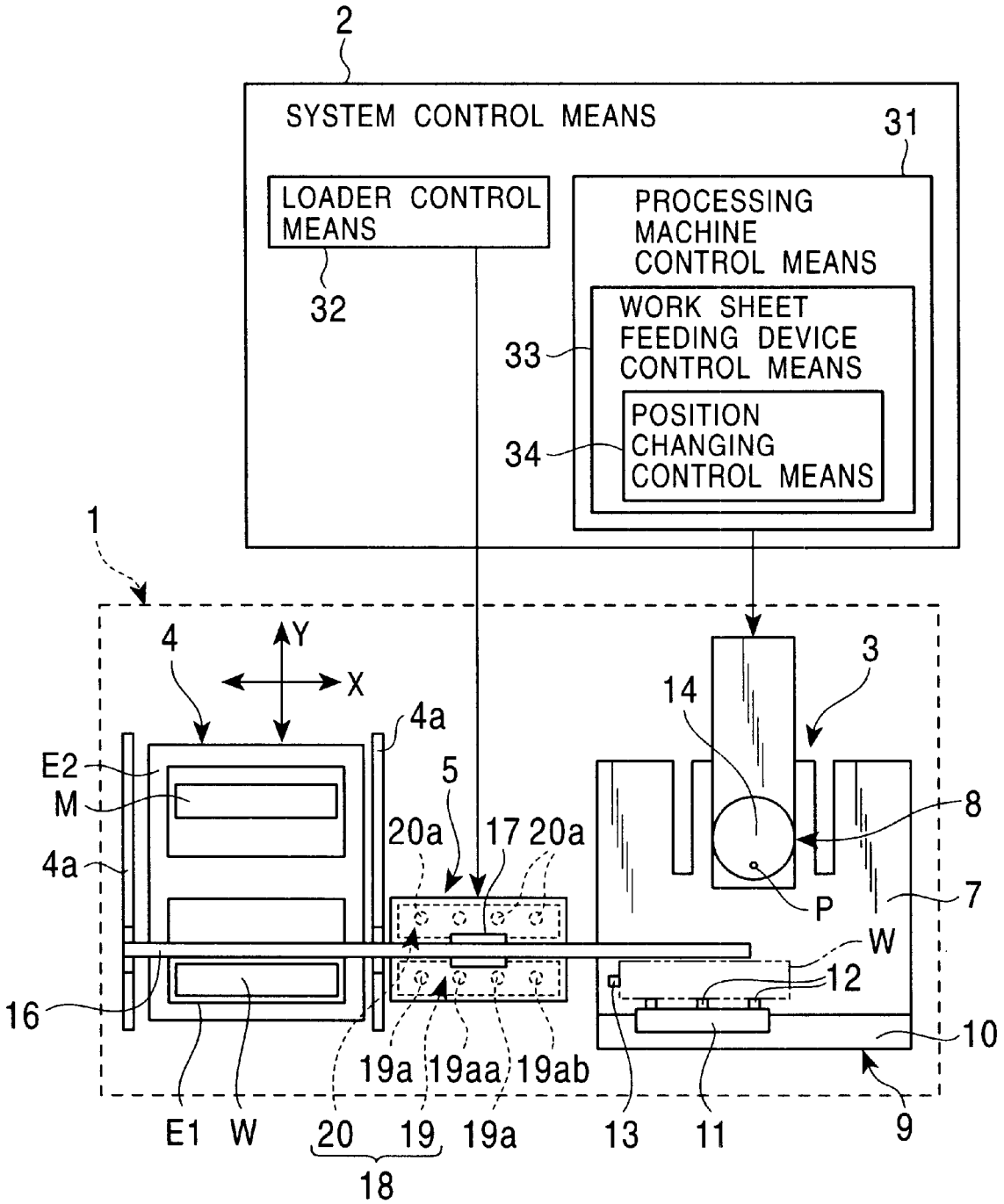
FIG. 1 is a block diagram showing the conception structure of the work sheet processing system according to an embodiment of the present invention.
Figure 2:
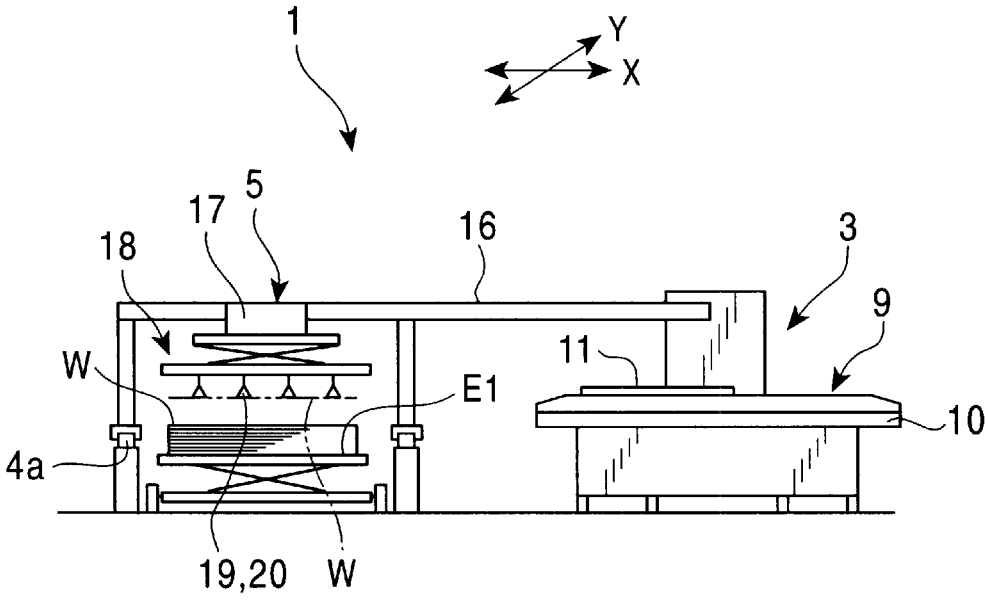
FIG. 2 is a plain view of the processing-transporting machine unit according to the system of the same.
Figure 3:
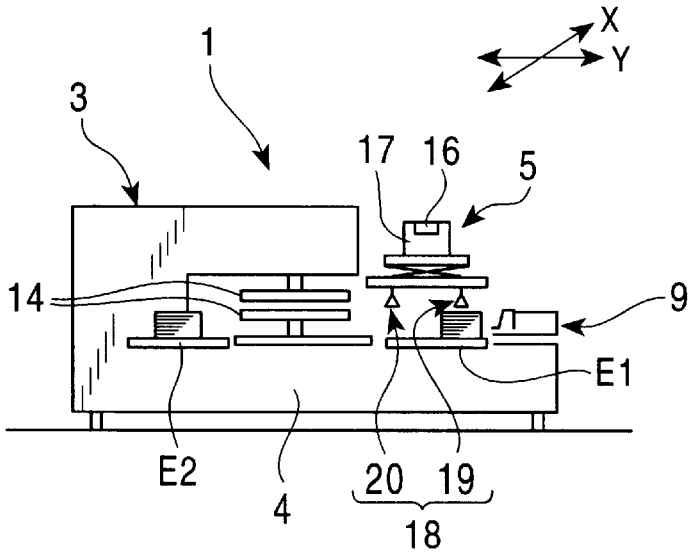
FIG. 3 is a side view of the processing-transporting machine unit according to the system of the same.

As shown in FIG. 1 through FIG. 3, the processing-transporting machine unit 1 is comprised mainly of a work sheet processing machine 3, a work sheet loading unit 4, and a loader 5.

The work sheet processing machine 3 is a machine for carrying out a process such as a hole opening to a material work sheet W on a table 7 to make a product work sheet M, and is comprised of such as a punch press or a laser processing machine. In the example illustrated in the figure, a turret punch press is adopted for the work sheet processing machine 3. The work sheet processing machine 3 comprises a work sheet feeding device 9 for feeding the material work sheet W on the table 7 against a processing unit 8 in the two axes direction perpendicular to one another (X, Y direction). The work sheet feeding device 9 is formed of a cross slide 11 transferring to the left and the right (X direction) provided on a carriage 10 transferring to the front and the back (Y direction), and a cross slide 11 attached to a work holder 12 which holds the material work sheet W. On the table 7, an end locater 13 used for determining the position of the material work sheet W transported onto the table 7 to the designated original position is provided capable of protruding or merging to the upper surface of the table 7.

The processing unit 8 includes a processing head comprised mainly of a turret 14 of an upper and a lower pair, and a punch driving mechanism (not shown in the drawings) for hitting a punch tool (not shown in the drawings) held at a plurality of places in the circumference direction of the turret 14 at a designated punch position P.

The work sheet loading unit 4 is provided with a material loading area E1 and a product loading area E2 arranged in a line. The direction in which both of these areas E1, E2 are arranged is to be in the direction perpendicular to the direction (X axis direction) where the work sheet processing unit 3 and the work sheet loading unit 4 are arranged. The material loading area E1 and the product loading area E2 are formed of the surface of such as a pallet or a cart located at a fixed position.

The loader 5 is a device for transporting the material work sheet W onto the table 7 of the work sheet processing machine 3, and for transporting out the processed product work sheet M from the table 7 of the work sheet processing machine 3. In other words, the loader 5 is used for the means for holding and transporting the material work sheet W onto the table 7 of the work sheet processing machine 3 from the material loading area E1 of the work sheet loading unit 4, and for holding and transporting out to the table 7, the product work sheet M which was processed by the work sheet processing machine 3 to the product loading area E2 of the work sheet loading unit 4.

The loader 5 comprises an installing rail 16 extending in the direction in which the work sheet processing machine 3 and the work sheet loading unit 4 are arranged (X axis direction), a running body 17 provided capable of running in the longitudinal direction (X axis direction) on the installing rail 16, and a work sheet holding means 18 provided capable of elevating or descending on the running body 17. The installing rail 16 can be provided fixed. However, in this example, the installing rail 16 is provided capable of running on the rail 4*a* on both sides of the work sheet loading unit 4, so that it is able to advance and recede in the direction perpendicular to the longitudinal direction (Y direction).

The work sheet holding means 18 comprises a material work sheet holding tool 19 for holding the material work sheet W, and a product work sheet holding tool 20 for holding the product work sheet M. The direction in which both of these holding tools 19, 20 are arranged is to be the same direction (Y axis direction) with the direction in which the material loading area E1 and the product loading area E2 are arranged. These holding tools 19, 20 are comprised of a plurality of suction pads 19*a*, 20*a*, which are arranged in a single line or a plurality of lines toward the direction in which for example, the work sheet processing machine 3 and the work sheet loading unit 4 are arranged (X axis direction). Suction pads 19*aa*, 19*ab* which are a part of the suction pad 19*a* which forms the material work sheet holding tool 19 are also used as a work sheet transferring means for transferring the material work sheet W transported onto the table 7 of the work sheet processing machine 3 to the original position of the table 7. To function as a work sheet transferring means, the suction pads 19*aa*, 19*ab* are not only capable of elevating or descending, but also capable of advancing or receding in the diagonal direction inclining a fixed angle to the X axis direction and the Y axis direction on the horizontal surface.

A plurality of suction pads 20*a* which is to be the product work sheet holding tool 20 are made by collecting a plurality of small suction pads, so that the suction is to be practicable without generation of troubles due to negative pressure leakage even with the product work sheet M with hole openings, and it is preferable to provide a squeeze or the like in each suction path. Moreover, the material work sheet holding tool 19 and the product work sheet holding tool 20 are not to be distinguished especially, a part of the suction pads provided in a plural lines can be used for the material work sheet holding tool 19, and the remaining members can be used for the product work sheet holding tool 20.

The system control means 2 will now be described in reference to FIG. 1. The system control means 2 comprises a processing machine control means 31 for controlling the work sheet processing machine 3, and a loader control means 32 for controlling the loader 5. The processing machine control means 31 carries out a program control, and comprises such as a NC device (number control device) and a programmable controller. The loader control means 32 carries out a program control of the number control device or the like. The processing machine control means 31 and the loader control means 32 can be construed of one computer machine or the like, or can be construed of computer machines or the like of which are independent of one another and then connected by a signal line or the like. For each computer machine, for example, a personal computer or the like can be used.

The processing machine control means 31 comprises a work sheet feeding device control means 33 for controlling the work sheet feeding device 9. The work sheet feeding device control means 33 includes a position changing control means 34. The position changing control means 34 controls the work sheet feeding device 9 so that the position of the product work sheet M is to be changed into the area wherein it can be transported out by the product work sheet holding tool 20, in the case the product work sheet M is not in the area capable of being transported out on the table 7 of the work sheet processing machine 3 by the product work sheet holding tool 20 of the loader 5. The judgment of whether or not the product work sheet M is within the area where it can be transported out by the product work sheet holding tool 20 of the loader 5, can be carried out by providing the position changing control means 34 with an appropriate judging function, or can be judged in the creating stage of the processing program for controlling the processing machine control means 31, and a command for the work sheet feeding device 9 to carry out the position changing operation can be set in the processing program.

Figure 4A:
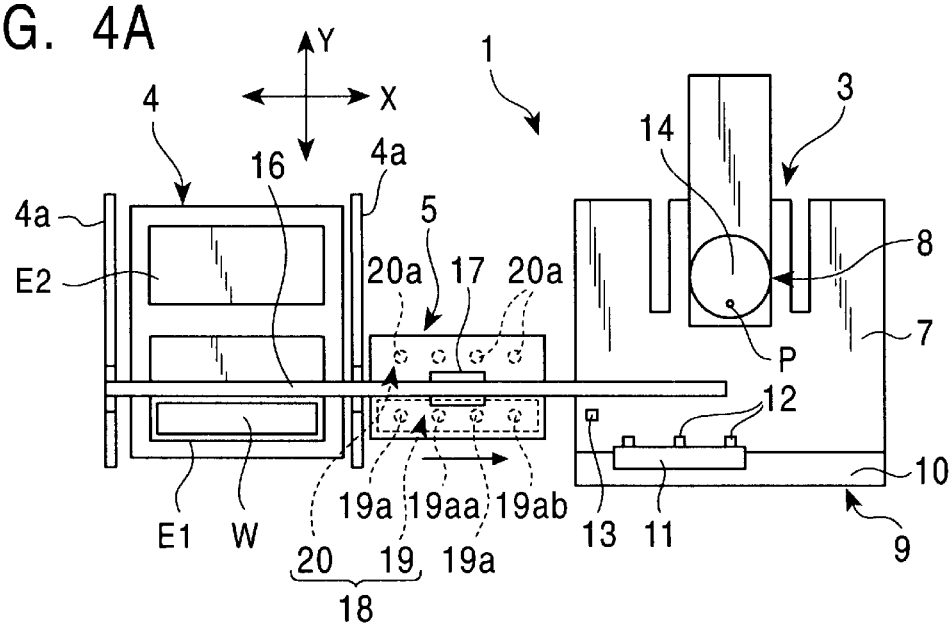
FIG. 4 is a view useful for explaining the material work sheet being transported in by the system of the same.
Figure 4B:
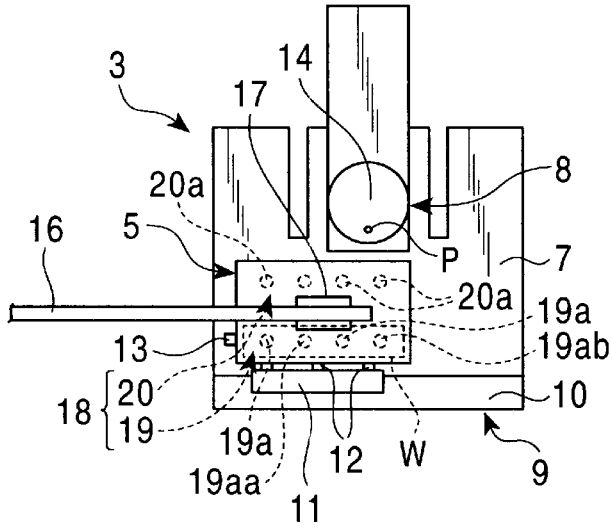
Figure 4C:
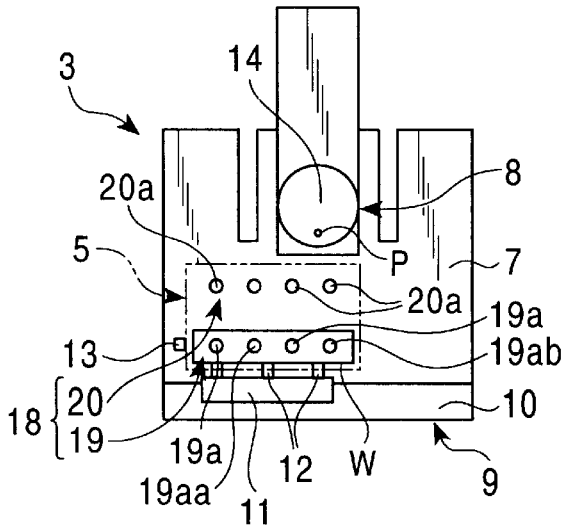

The operation of the structure described above will be described. First, as shown in FIGS. 4A and 4B, the loader 5 holds one of the sheets of the material work sheet W loaded on the material loading area E1 of the work sheet loading unit 4 by the suction pad 19*a* of the material work sheet holding unit 19, and then the material work sheet W is transported onto the table 7 of the work sheet processing machine 3. Under such state in which the material work sheet W is transported, as shown in FIG. 4C, the material work sheet W is to be pressed against the end locator 13 protruding on the table 7 and the work holder 12 of the work sheet feeding device 9 waiting at the original position, due to the diagonal transferring by the suction pads 19*aa,* 19*ab* which are a part of the suction pad 19*a*. Accordingly, the position of the material work sheet W is fixed to the original position on the table 7.

As in the manner stated above, the material work sheet W transported to the original position on the table 7, is fed front and back, left and right, by being held by the work holder 12 of the work sheet feeding device 9, and is punch processed at a punch position P of the processing unit 8 to become the product work sheet M.

When the processing is completed, the work holding 12 of the works sheet feeding device 9 is to be holding onto the product work sheet M. However, generally, the product work sheet M is not located within the area capable of being transported out by the material work sheet holding tool 19 of the loader 5, at the time being. In such case, as shown in FIG. 5A, by the control of the work sheet feeding device 9 by the position changing control means 34 included in the work sheet feeding device control means 33, the position of the product work sheet M is changed to the area where it can be transported out by the product work sheet holding unit 20 of the loader 5, and is separated from the work holder 12. Then, the work sheet feeding device 9 becomes on standby at the original position opened on the table area of the material work sheet W to be transported in by the loader 5. Under such condition, as shown in FIG. 5B, the loader 5 holds only one sheet of the material work sheet W from the material loading area E1 of the work sheet loading unit 4, by the material work sheet holding tool 19, and transports the material work sheet W onto the table 7 of the work sheet processing machine 3. When the work sheet holding means 18 descends for this transportation to release the suction of the suction pad 19*a,* at the same time, the loader 5 sucks and holds onto the product work sheet M on standby on the table 7, with the suction pad 20*a* of the product work sheet holding tool 20.

Then, in the same manner as the previous transporting in of the material work sheet, the position of the material work sheet W is fixed to the original position by being pressed against the end locater 13 and the work holder 12 of the work sheet feeding device 9 by the suction pads 19*aa,* 19*ab* which are a part of the material work sheet holding tool 19. Consequently, the loader 5 holds up the product work sheet M by the product work sheet holding tool 20, and transports the product work sheet M out to the product loading area E2 of the work sheet loading unit 4.

In the manner stated above, according to the work sheet processing system of the present invention, by one round trip operation of the loader 5, the material work sheet W can be transported into the work sheet processing machine 3 from the work sheet loading unit 4, and the product work sheet M can be transported out to the work sheet loading unit 4 from the work sheet processing machine 3. As a result, the processing cycle of the system can be shortened.

Moreover, when the product work sheet M is not located within the area capable of being transported out by the product work sheet holding tool 20 of the loader 5 on the table 7 of the work sheet processing machine 3, by the control of the work sheet feeding device 9 by the position changing control means 34, the position of the product work sheet M is changed to the area capable of being transported out by the product work sheet holding tool 20. Therefore, even in the case wherein the processing form or the processing shape of the product work sheet M differs variously, the material work sheet W can be transported in and the product work sheet M can be transported out by one around trip of the loader 5.

Furthermore, since the position of the product work sheet M is changed by the position changing control means 34 by using the work sheet feeding device 9 provided for the processing by the work sheet processing machine 3, a special mechanism for changing the position of the product work sheet M becomes unnecessary.

The work sheet processing system according to the present invention comprises the work sheet processing machine for processing the work sheet, and the loader for transporting the material work sheet onto the table of the work sheet processing machine and for transporting out the process product work sheet from the table of the work sheet processing machine. The loader includes a work sheet holding means comprised of a material work sheet holding tool for holding the material work sheet, and a product work sheet holding means for holding the product work sheet. The processing machine control means is provided for controlling the work sheet processing machine so that the product work sheet is to be on standby by being located within the area capable of being transported out by the product work sheet holding member of the loader after the work sheet processing machine opens a space on the table of the material work sheet transported in by the loader. Moreover, a loader control means is provided for controlling the loader so that the loader transports out by holding the product work sheet when the material work sheet is placed on the table. Therefore, by the operation of one round trip of the loader, the material work sheet can be transported into the work sheet processing machine and the product work sheet can be transported out from the work sheet processing machine.

In the case the product work sheet is not located within the area to be transported out by the product work sheet holding unit of the loader, when the position changing control means for the work sheet processing machine to carry out the position changing operation is provided so that the position of the product work sheet is changed to the area capable of being transported out by the product work sheet holding unit, even when the processing form or the processing shape of the work sheet differs variously, the material work sheet can be transported in and the product work sheet can be transported out smoothly by one round trip of the loader.

In the case the work sheet processing machine comprises a work sheet feeding device for feeding a work sheet, and the position changing control means controls the work sheet feeding device, since the work sheet feeding device for feeding the work sheet can be used for changing the position of the product work sheet, a special mechanism for changing the position of the product work sheet becomes unnecessary.

What is claimed is:

1. A work sheet processing system comprising:

a work sheet processing machine for processing a work sheet;

a loader for transporting a material work sheet onto a table of the work sheet processing machine and for transporting a processed product work sheet out from the table of the work sheet processing machine, wherein the loader includes a work sheet holding means comprised of a material work sheet holding tool for holding the material work sheet, and a product work sheet holding tool for holding the product work sheet;

a processing machine control means for controlling the work sheet processing machine so that the work sheet processing machine opens a space on the table for the material work sheet to be transported in by the loader, and the product work sheet is to be on standby by being placed within the area capable of being transported out by the product work sheet holding member of the loader; and a loader control means for controlling the loader so that the loader holds and transports out the product work sheet when the material work sheet is placed on the table.

2. A work sheet processing system according to claim 1 comprising:

a position changing means for the work sheet processing machine to carry out position changing operation so that the position of the product work sheet is to be changed to the area capable of being transported out by the product work sheet holding unit in the case the product work sheet is not locates within the area capable of being transported out by the product work sheet holding unit of the loader.

3. A work sheet processing system according to claim 2 wherein the work sheet processing machine comprises a work sheet feeding device for feeding a work sheet to be processed, and the position changing control means controls the work sheet feeding device.

* * * * *